US007996960B2

(12) United States Patent
Balbo Di Vinadio

(10) Patent No.: US 7,996,960 B2
(45) Date of Patent: Aug. 16, 2011

(54) HINGE FOR DOORS OR WINDOWS

(75) Inventor: Aimone Balbo Di Vinadio, Chiusa San Michele (IT)

(73) Assignee: SAVIO S.p.A., Chiusa San Michele (Torino) (IT)

( * ) Notice: Subject to any disclaimer, the term of this patent is extended or adjusted under 35 U.S.C. 154(b) by 409 days.

(21) Appl. No.: 12/361,848

(22) Filed: Jan. 29, 2009

(65) Prior Publication Data

US 2009/0193623 A1 Aug. 6, 2009

(30) Foreign Application Priority Data

Jan. 31, 2008 (EP) ..... 08425058

(51) Int. Cl.
*E05D 5/02* (2006.01)

(52) U.S. Cl. ..... 16/384; 16/262; 16/380; 16/386

(58) Field of Classification Search ..... 16/260, 16/261, 262, 263, 264, 270, 271, 272, 380, 16/381, 386, 387, 382; 49/396, 397
See application file for complete search history.

(56) References Cited

U.S. PATENT DOCUMENTS

| | | | | | |
|---|---|---|---|---|---|
| 3,263,269 | A | * | 8/1966 | McGahee | 16/380 |
| 4,675,940 | A | * | 6/1987 | Brockhaus | 16/386 |
| 4,864,689 | A | * | 9/1989 | Brockhaus | 16/262 |
| 4,980,946 | A | * | 1/1991 | Verasani et al. | 16/272 |
| 5,095,583 | A | * | 3/1992 | Prevot | 16/270 |
| 5,150,500 | A | * | 9/1992 | Bisbing | 16/387 |
| 5,819,372 | A | * | 10/1998 | Magoon | 16/380 |

FOREIGN PATENT DOCUMENTS

| | | | |
|---|---|---|---|
| DE | 43 02 599 | | 2/1994 |
| EP | 314616 | A1 * | 5/1989 |
| EP | 387207 | A1 * | 9/1990 |
| EP | 570945 | A1 * | 11/1993 |
| EP | 0 733 762 | | 9/1996 |
| EP | 1 085 155 | | 3/2001 |
| FR | 2.214.316 | | 8/1974 |

OTHER PUBLICATIONS

European Search Report issued Oct. 13, 2008 in connection with corresponding EP App No. 08425058.8.

* cited by examiner

*Primary Examiner* — Victor Batson
*Assistant Examiner* — Jeffrey O'Brien
(74) *Attorney, Agent, or Firm* — Nixon & Vanderhye P.C.

(57) ABSTRACT

A hinge for doors or windows, comprising a hinge-pin (26) defining an axis of rotation (28), a first hinge element (22) and a second hinge element (24), which are articulated to one another about said axis (28) via said pin (26), the hinge including a reinforcement kit comprising an extension element (32) that can be applied by shape fit to an end of the pin (26), and a third hinge element (30) connectable to the first hinge element (22) in a pre-set position and having a hole (82) that can be engaged by said extension element (32) of the pin (26).

8 Claims, 12 Drawing Sheets

HINGE FOR DOORS OR WINDOWS

BACKGROUND OF THE INVENTION

The present invention relates to a hinge for doors or windows, in particular for doors or windows with aluminium frames.

Hinges for doors or windows normally comprise a first, fixed, hinge element and a second, mobile, hinge element, articulated to one another by means of a pin. The hinges formed only by a first hinge element and the second hinge element are referred to as two-leaf hinges. In this type of hinge, the pin has a section that projects in cantilever fashion from the fixed hinge element and is thus subjected to bending stress. Hinges of this type have a relatively low loading limit, for example in the region of 100 kg.

In the case where the hinge has to ensure a resistance to a higher load, hinges with three leaves are normally used, comprising a bottom fixed hinge element, a central mobile hinge element, and a top fixed hinge element. Hinges of this type have a higher loading limit than two-leaf hinges, for example in the region of 150 kg. However, the difference in cost between hinges with three leaves and hinges with two leaves is quite considerable. With the solutions of current production, in the case where the hinge has to ensure a resistance to a load intermediate between the load of a hinge with two leaves and that of a hinge with three leaves, for example 110 kg, it is necessary to use three-leaf hinges.

The object of the present invention is to provide a hinge of the two-leaf type provided with a reinforcement kit that enables raising of the loading limit of the two-leaf hinge up to an intermediate level between that of normal two-leaf hinges and three-leaf hinges, for example in the region of 130 kg.

SUMMARY OF THE INVENTION

According to the present invention, the above object is achieved by a hinge comprising a reinforcement kit comprising an extension element configured as an element detached from the pin that can be applied by shape fit to said second end of the pin, said extension element projecting beyond the top front end of the second hinge element, and a third hinge element configured as element separate from the first and from second hinge elements and connectable to the first hinge element in a pre-set position, the third hinge element having a hole that can be engaged by said extension element of the pin.

The hinge according to the present invention is configured as a normal two-leaf hinge and has a reinforcement kit that transforms the hinge into a three-leaf hinge. The cost of the hinge with reinforcement kit is lower than that of a three-leaf hinge of a conventional type. A particularly important advantage of the hinge according to the present invention is that the reinforcement kit can be applied at any moment, also with the door or window already set in place.

DESCRIPTION OF THE DRAWINGS

The characteristics and advantages of the hinge according to the present invention will emerge clearly from the ensuing detailed description, which is provided purely by way of non-limiting example, with reference to the attached drawings, in which.

DESCRIPTION OF THE PREFERRED EMBODIMENT

Figure 1:
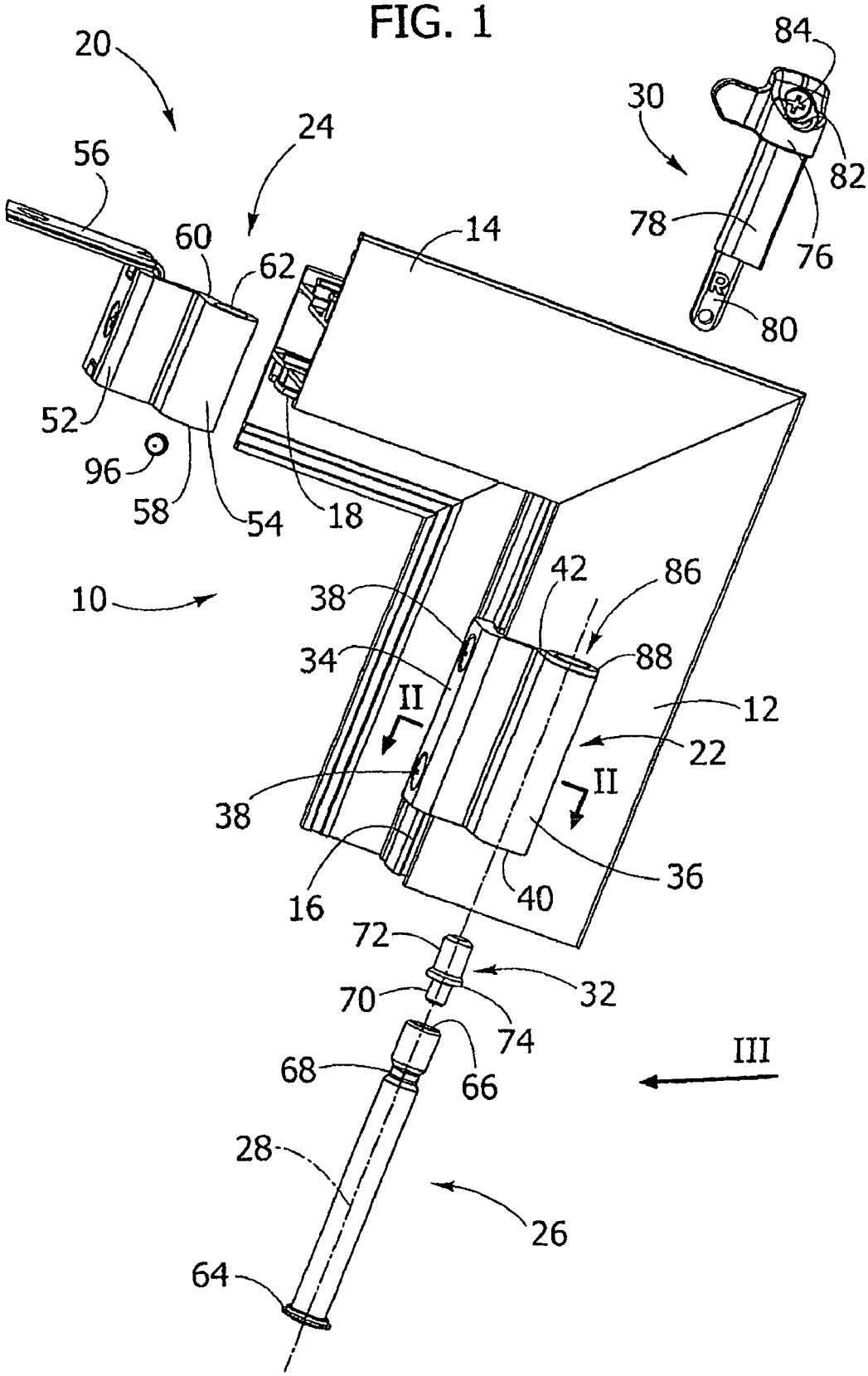
FIG. 1 is an exploded perspective view of a hinge according to the present invention partially mounted on the frame of a door or window.

With reference to FIG. 1, designated by 10 is a part of a fixed frame of a door or window, including a vertical upright 12 and a horizontal cross member 14. The uprights and cross members forming the frame 10 are made up of sectional elements of aluminium of a conventional type, provided with longitudinal slots 16, 18 facing the inside of the opening of the door or window.

In FIG. 1, a hinge according to the present invention is designated as a whole by 20. The hinge 20 comprises a first hinge element 22 and a second hinge element 24, articulated to one another by means of a hinge-pin 26 defining an axis of articulation 28. The hinge 20 according to the present invention moreover comprises a reinforcement kit including a third hinge element 30 and an extension element 32, which can be applied to one end of the pin 26.

Figure 2:
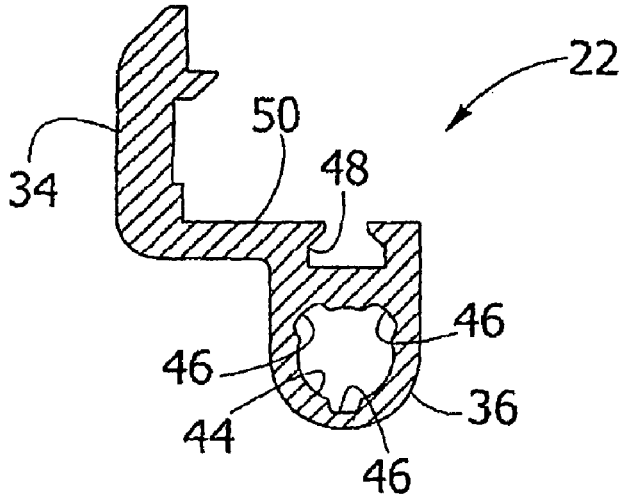
FIG. 2 is a cross section of the first hinge element according to the line II-II of FIG. 1.

With reference to FIGS. 1 and 2, the first hinge element 22 is formed by a monolithic body of metal material having a fixing portion 34 and an articulation portion 36. The fixing portion 34 is configured for being fixed to the longitudinal groove 16 of the upright 12 by means of a pair of screws 38. The way in which the first hinge element 22 is fixed to the upright 12 is conventional in the sector of accessories for doors and windows made of aluminium and does not call for an in-depth description.

Figure 6:
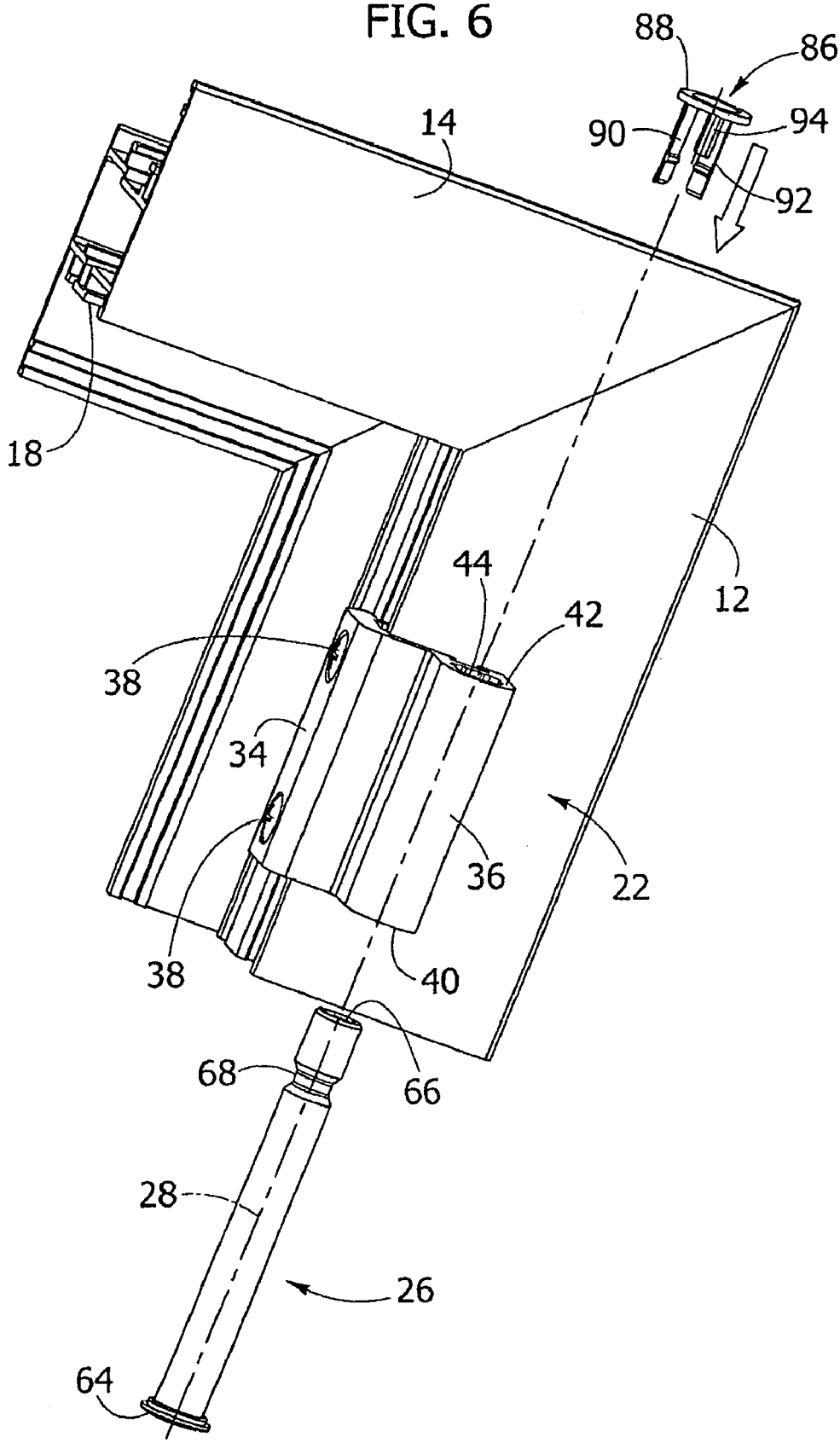
FIGS. 6-13 are perspective views illustrating the sequence of assembly of the hinge according to the present invention.

With reference to FIGS. 1, 2 and 6, the articulation portion 36 of the first hinge element 22 has a bottom front end 40 and a top front end 42. The articulation portion 36 has a through articulation seat 44, which extends between the front ends 40, 42. With reference in particular to FIG. 2, the articulation seat 44 has three longitudinal grooves 46 that project outwards with respect to a circular profile. The articulation portion 36 moreover comprises a groove with undercut cross section 48 having a longitudinal axis parallel to the longitudinal axis of the articulation seat 44. The groove with undercut cross section 48 is open on a face 50 of the articulation portion 36, which, in use, rests on a plane face of the upright 12.

With reference to FIG. 1, the second hinge element 24 comprises a fixing portion 52 and an articulation portion 54. The fixing portion 52 is configured for fixing to an L-shaped arm 56. The arm 56 serves to connect the second hinge element 24 to the openable leaf (not illustrated of the door or window. The second hinge element 24 is fixed to a scissor-like arm in the case of a door or window with wing-like and swivel-like opening. In the case of a door or window that can only be opened in a wing-like way, the second hinge element 24 is fixed by means of the arm 56 to the frame of the openable leaf. The articulation portion 54 of the second hinge element 24 has a bottom front end 58, a top front end 60, and a through articulation seat 62 that extends between the front ends 58, 60.

Figure 3:
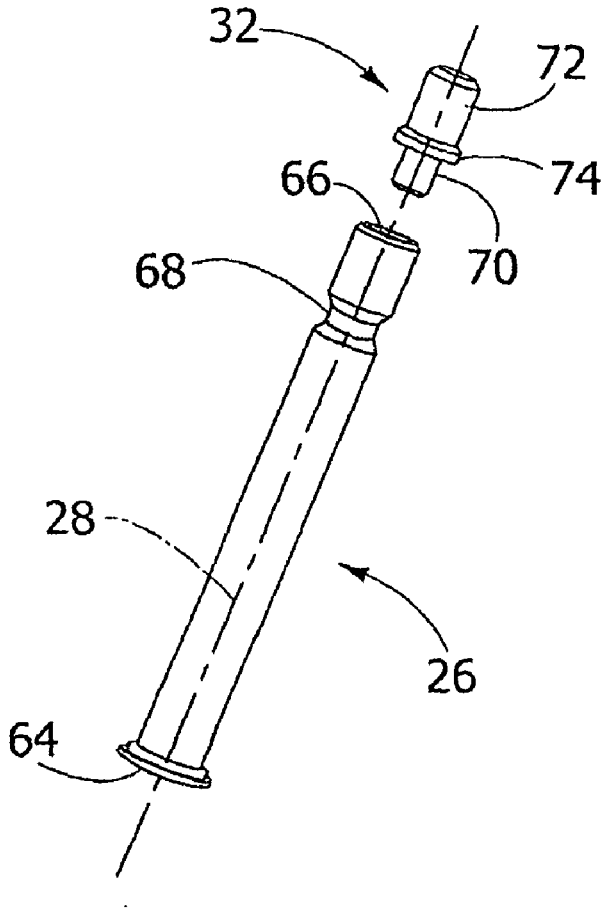
FIGS. 3 and 4 are perspective views of the hinge-pin indicated by the arrow III in FIG. 1.
Figure 4:
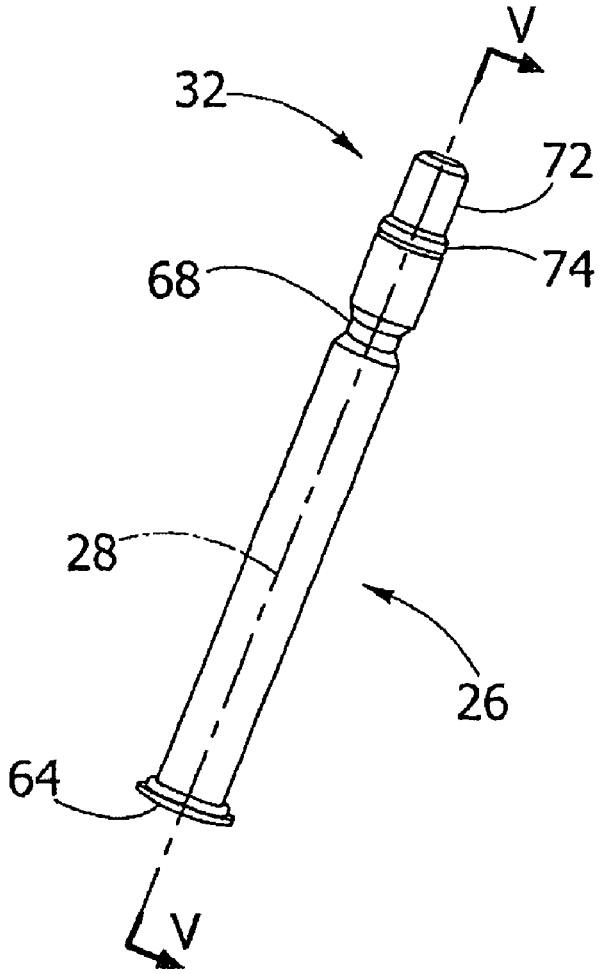
Figure 5:
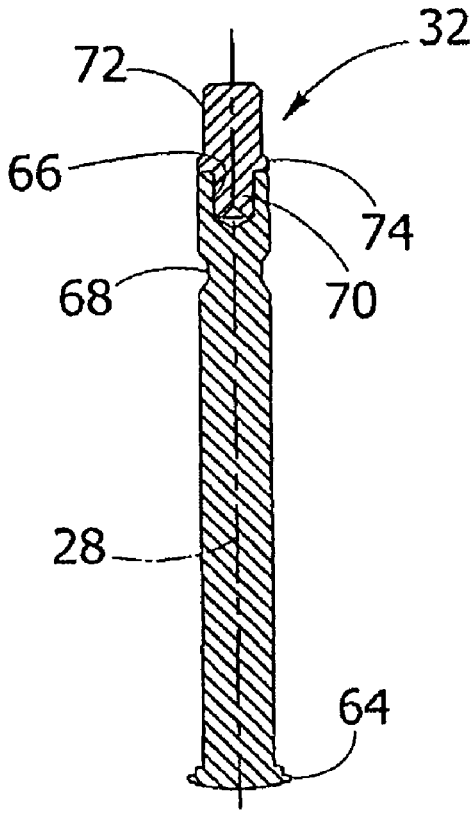
FIG. 5 is a cross section according to the line V-V of FIG. 4.

With reference to FIGS. 3-5, the hinge-pin 26 has a cylindrical body with circular cross section having at a first end a widened head 64. At the opposite end, the pin 26 has a blind hole 66 sharing the axis 28. The pin 26 is provided on its external surface with an annular groove 68. Preferably, the pin 26 has a constant external diameter, with the exception of the stretches in which the groove 68 and the head 64 are formed.

Once again with reference to FIGS. 3-5, the extension element 32 is configured as an element detached from the pin 26 and comprises a first cylindrical portion 70 and a second cylindrical portion 72, which are coaxial with respect to one another and are separated by a radial collar 74. The first cylindrical portion 70 has a smaller diameter than the second cylindrical portion 72, and the collar 74 projects in a radial direction beyond the external surface of the second cylindrical portion 72. The first cylindrical portion 70 is sized so as to establish a shape fit with the blind hole 66 formed at the end of the pin 26. The collar 74 preferably has an external diameter substantially equal to the external diameter of the pin 26. In the condition where the first cylindrical portion 70 of the extension element 32 is fitted in the hole 66, the collar 74 rests on the front end of the pin 26 where the hole 66 gives out. As may be noted in FIGS. 4 and 5, when the extension element 32 is fitted to the pin 26, the second cylindrical portion 72 forms an extension of the pin 26 coaxial to the axis 28.

With reference to FIG. 1, the third hinge element 30 is configured as element separate from the first hinge element 22 and the second hinge element 24 and comprises a monolithic body of metal material comprising a head 76, a spacing portion 78, and a coupling portion 80. The coupling portion 80 is shaped to be inserted by shape fit into the groove with undercut cross section 48 of the first hinge element 22. The spacing portion 78 has a height in the direction of the axis of articulation 28 slightly greater than the height of the articulation portion 54 of the second hinge element 24. The head 76 has a hole 82 intended to receive the second cylindrical portion 72 of the extension element 32. The head 76 of the third hinge element 30 is moreover provided with a fixing hole designed to receive a screw 84.

With reference to FIGS. 1 and 6, the hinge 20 according to the present invention moreover comprises a washer 86 that is applied on the top front end 42 of the first hinge element 22. The washer 86 comprises an annular portion 88 and three integral arms 90, 92, 94, which extend in an axial direction from the annular portion 88. The washer 86 is described in a more detailed way in a simultaneous patent application filed in the name of the present applicant.

The sequence of assembly of the hinge according to the present invention will now be described with reference to FIGS. 6-13.

Figure 7:
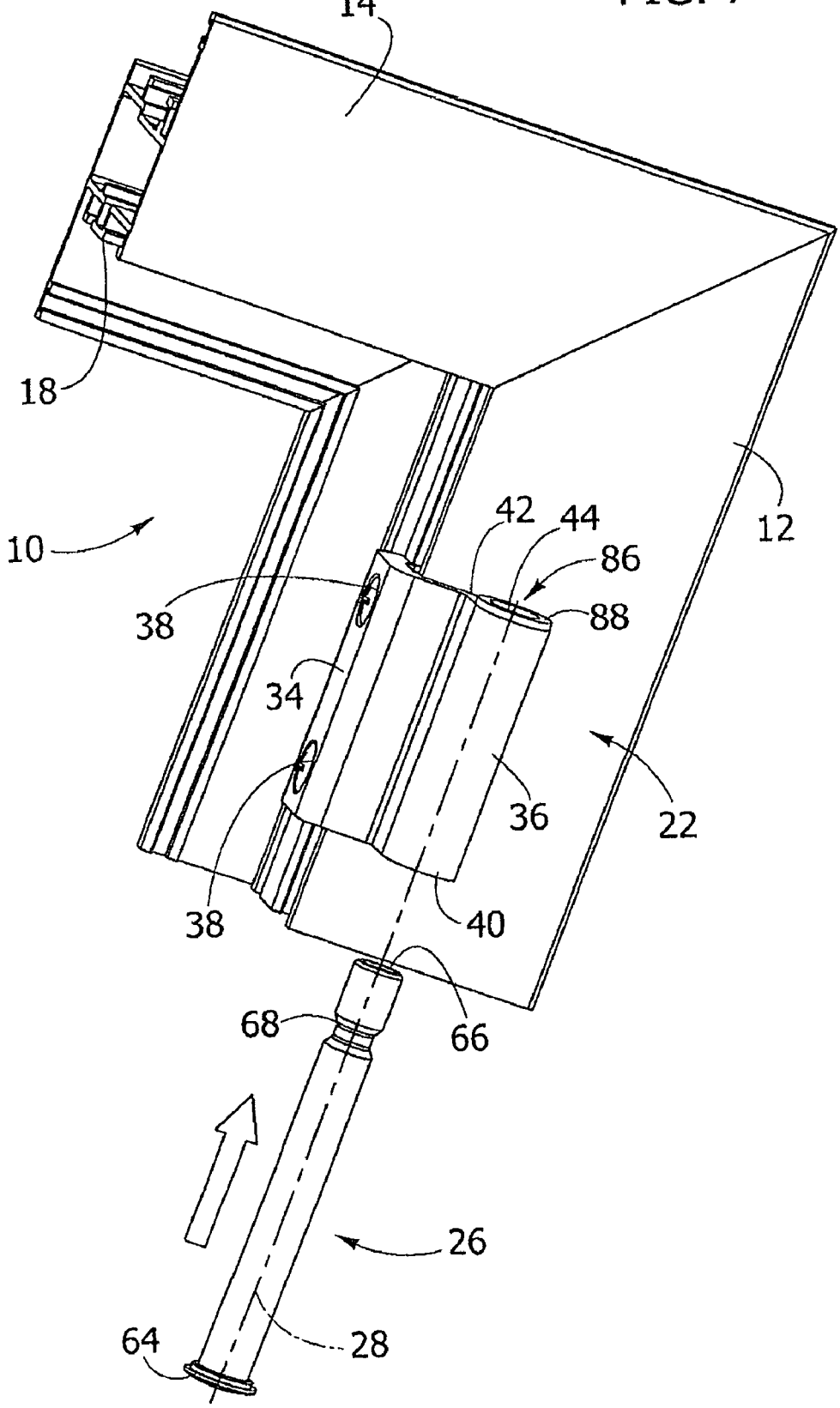
Figure 8:
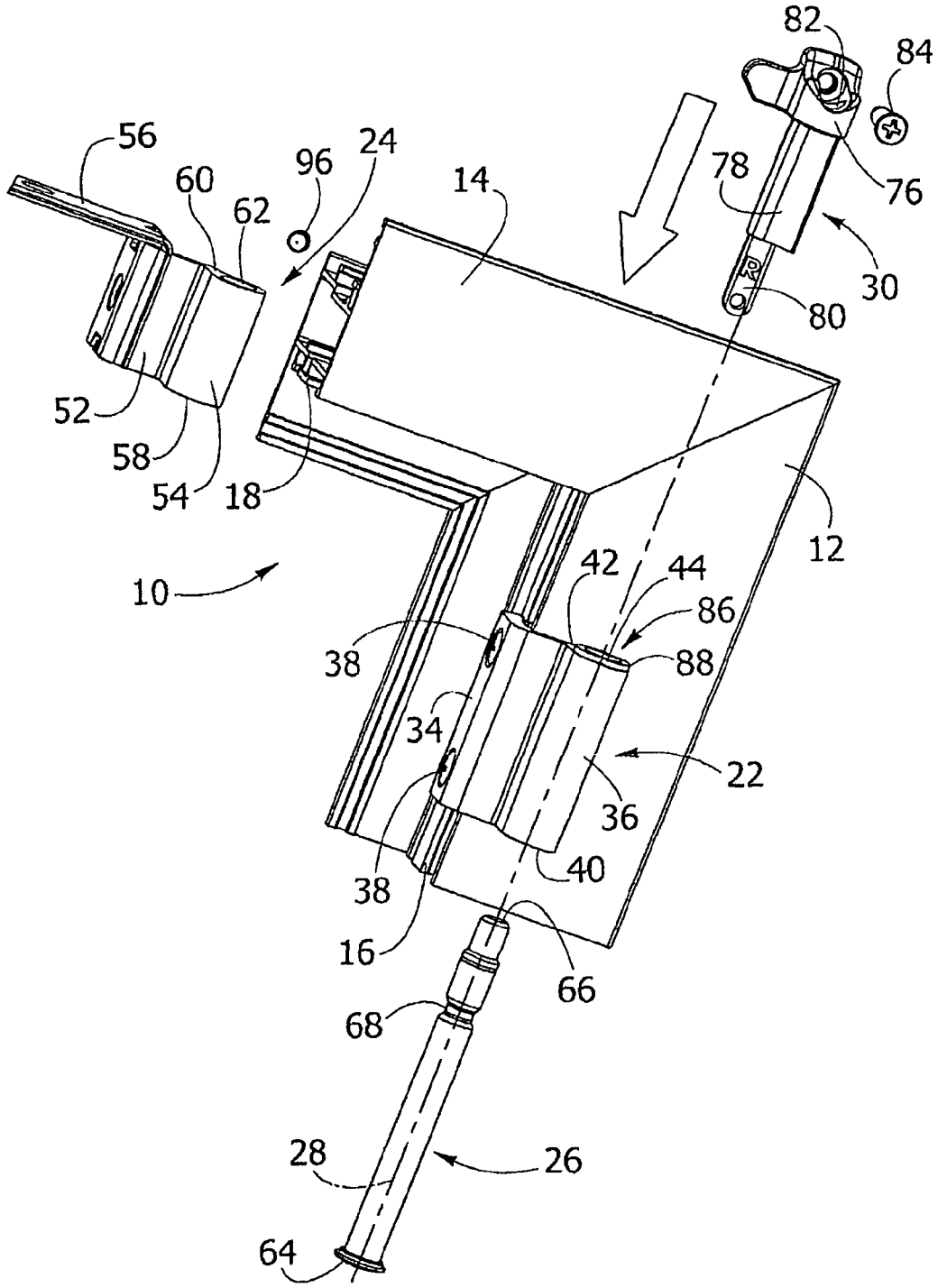
Figure 9:
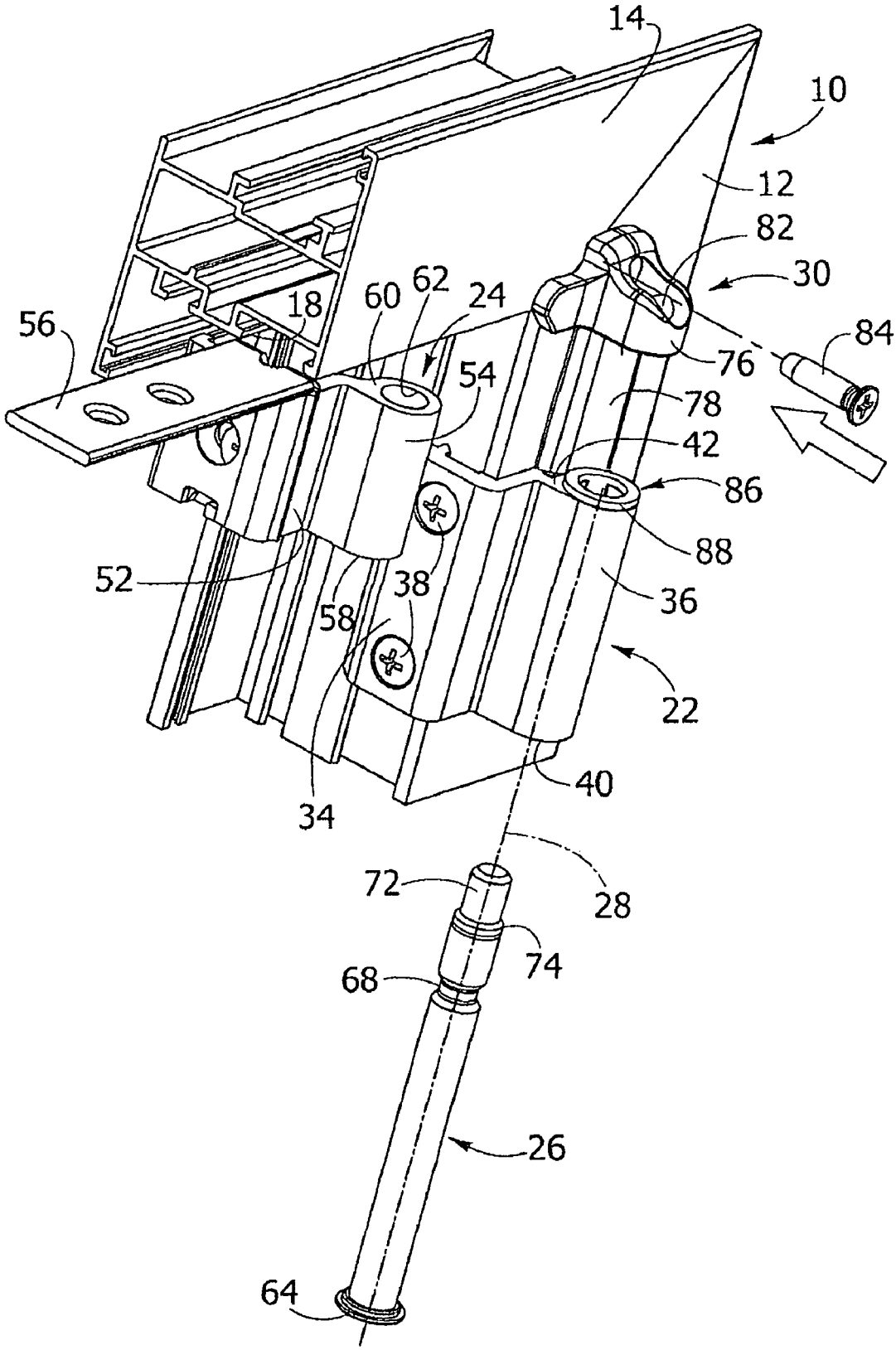

With reference to FIG. 6, in a first step the first hinge element 22 is fixed to the upright 12 by means of screws 38 according to modalities in themselves conventional. Then, the washer 86 is inserted into the seat 44, on the side of the top front end 42. The arms 90, 92, 94 of the washer 86 are inserted in the grooves 46 of the seat 44. FIG. 7 shows the washer 86 inserted in the seat 44. Then, as illustrated in FIG. 8, the third hinge element 30 is fitted to the first hinge element 22, as illustrated in FIGS. 8 and 9. The coupling portion 80 of the third hinge element 30 is inserted in the groove with undercut cross section 48 of the first hinge element 22. The third hinge element 30 is located in the correct position when the spacing portion 78 comes to bear upon the top front end of the first hinge element 22 (FIG. 9). In this condition, the third hinge element is fixed to the upright 12 by means of the screw 84, as illustrated in FIG. 9.

Figure 10:
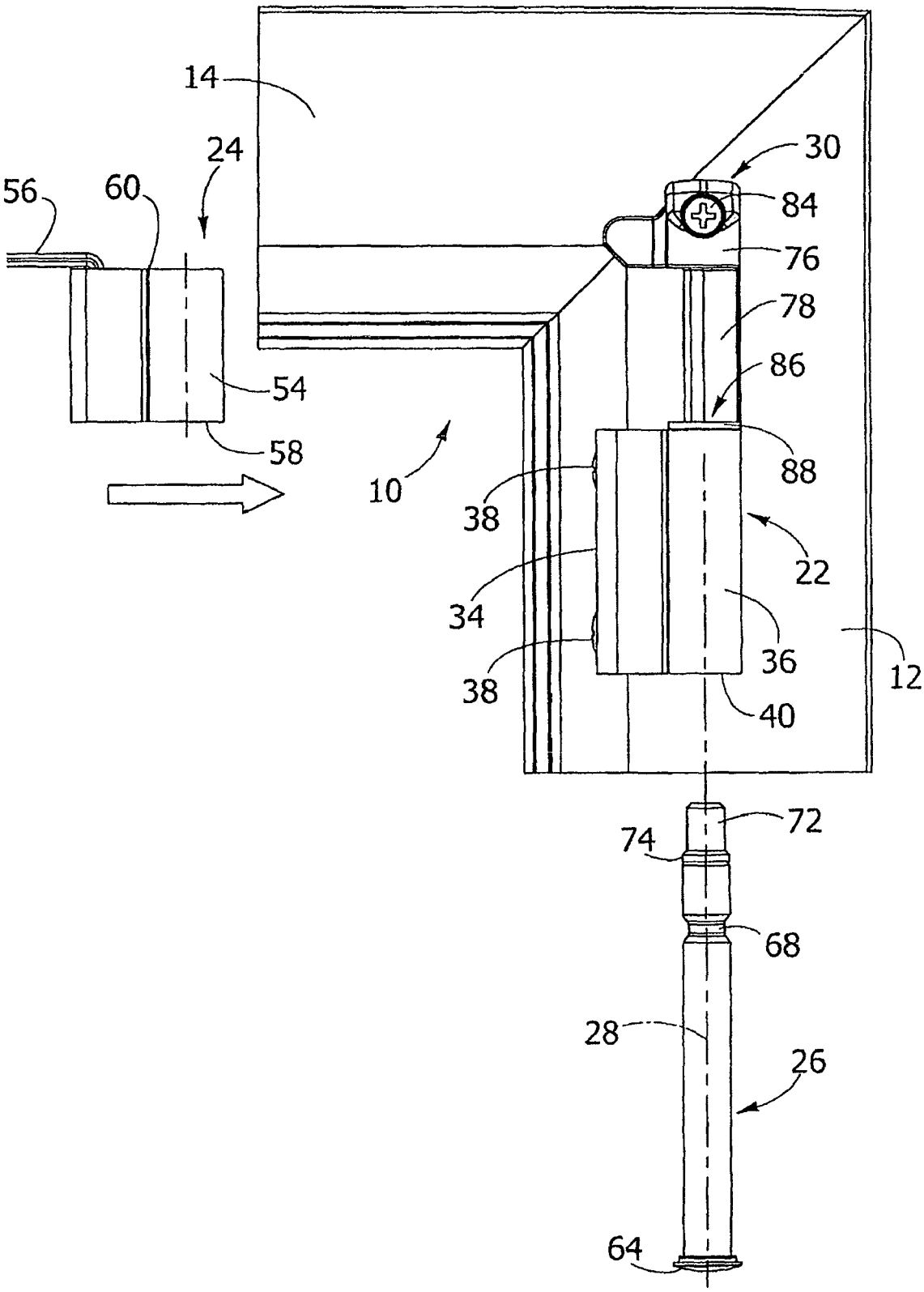
Figure 11:
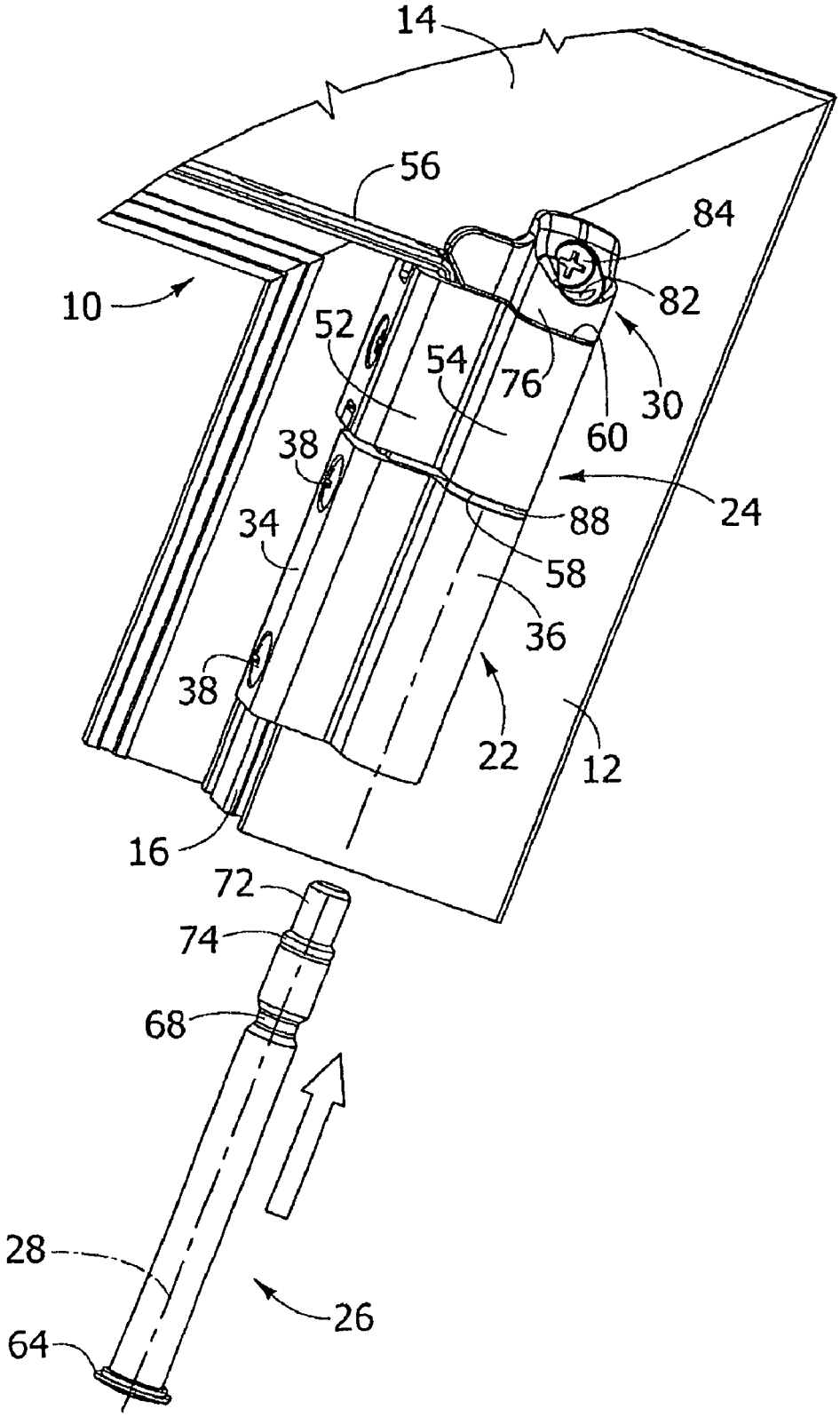

Next, as illustrated in FIG. 10, the second hinge element 24 is inserted in the direction indicated by the arrow in FIG. 10 in the space comprised between the head 76 of the third hinge element 30 and the top front end 42 of the second hinge element 22. The second hinge element 24 is positioned with the articulation seat 62 aligned to the articulation seat 36 and to the hole 82 of the third hinge element 30, as illustrated in FIG. 11.

Figure 12:
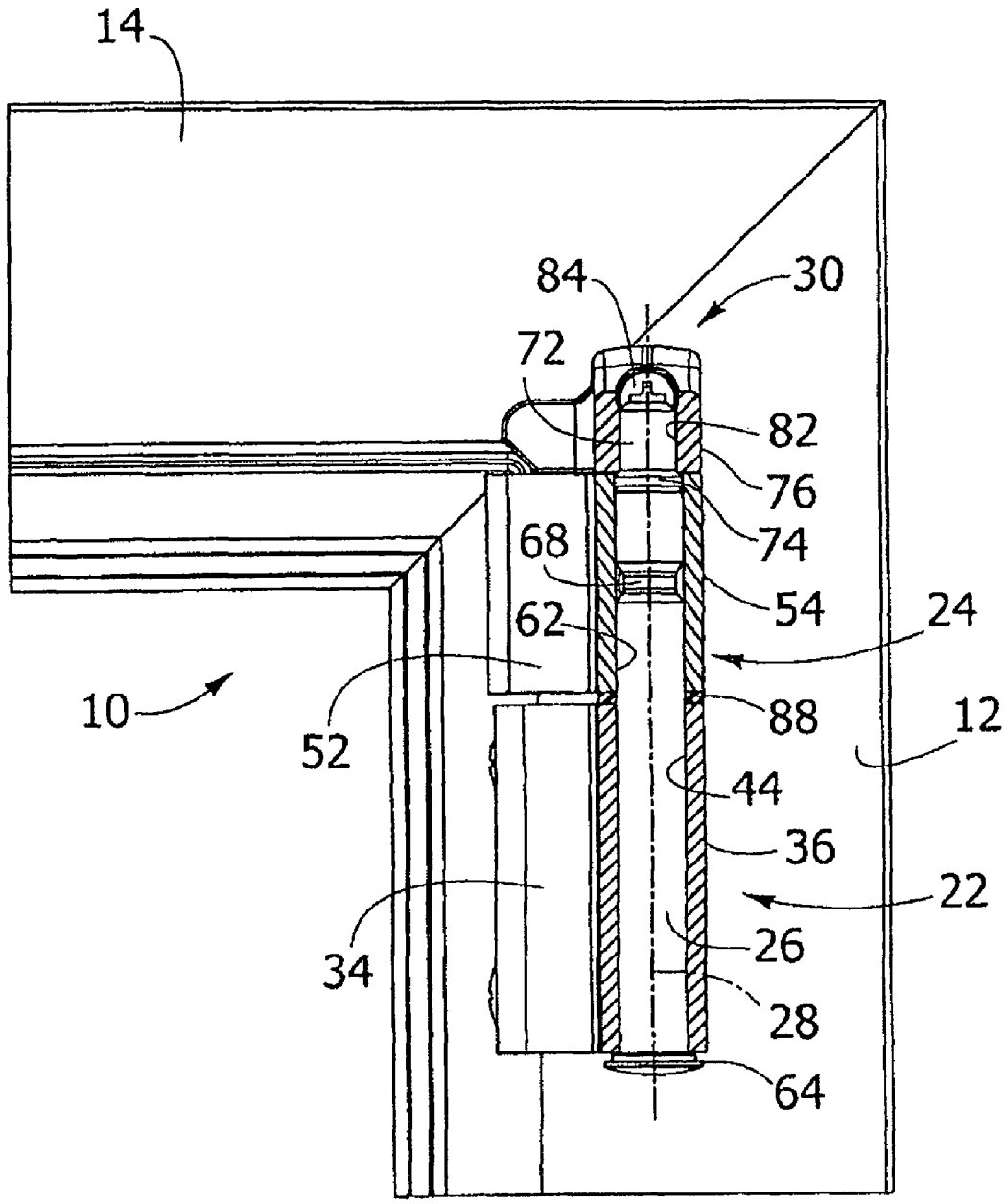

In the meantime, the extension element 32 is applied to the end of the pin 26, and the pin assumes the configuration illustrated in FIG. 10. The pin 26, with the corresponding extension element 22, is then inserted into the articulation seats, aligned with respect to one another, of the first and second hinge elements, in the direction indicated by the arrow in FIG. 11. The cross section of FIG. 12 shows the hinge after complete insertion of the pin. It may be noted that the second cylindrical portion 72 of the extension element 32 engages the hole 82 of the third hinge element. It may moreover be noted that the annular portion 88 of the washer 86 is comprised between the top front end of the first hinge element 22 and the bottom front end of the second hinge element 24.

Figure 13:
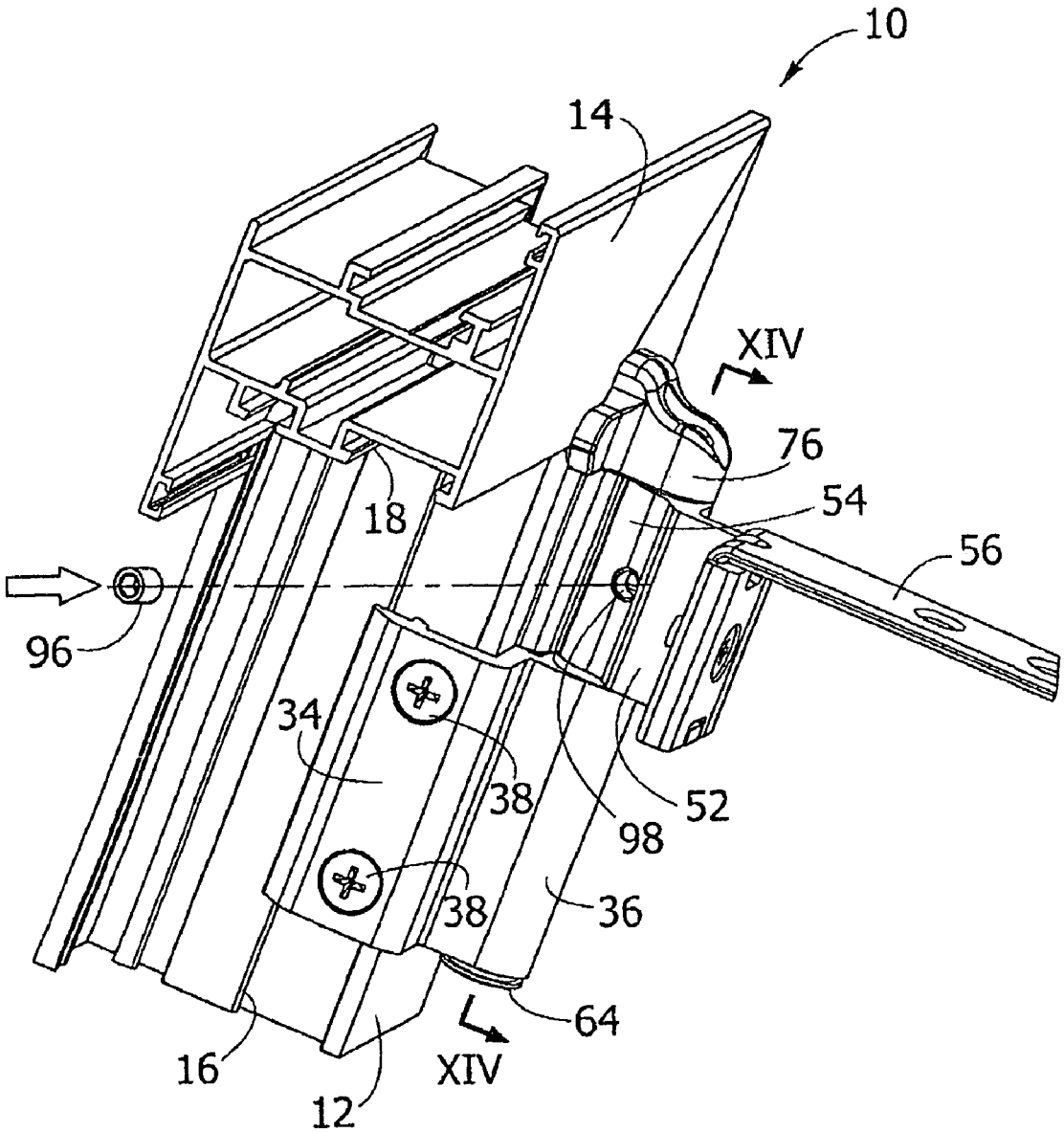
Figure 14:
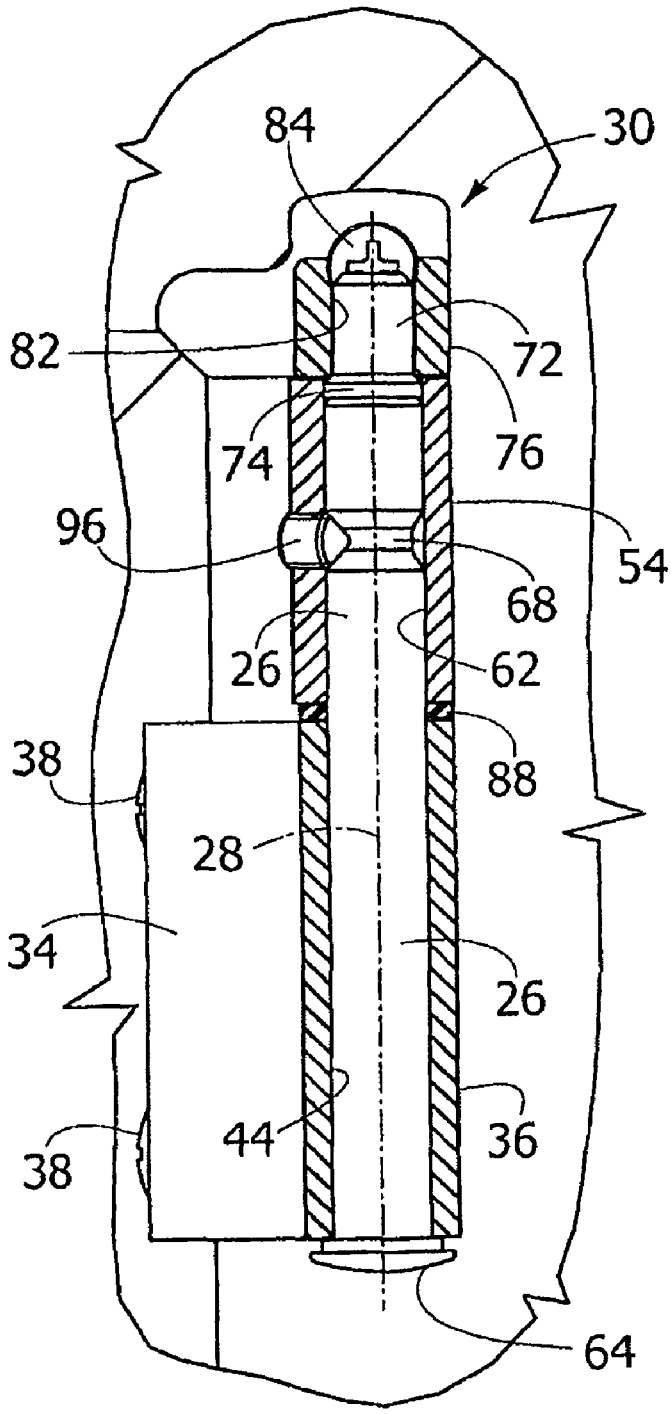
FIG. 14 is a cross section according to the line XIV-XIV of FIG. 13.

The assembly is completed, as illustrated in FIGS. 13 and 14, by screwing a grubscrew 96 in a transverse threaded hole 98 of the second hinge element 20. The threaded hole 98 is situated in a position corresponding to the annular groove 68 of the pin 26. Consequently, the internal end of the grubscrew 96 engages the annular groove 68 of the pin 26 as illustrated in FIG. 14.

The procedure of assembly described previously refers to the complete hinge 20 of the reinforcement kit 30, 32. The hinge 20 can also be mounted without the reinforcement kit 30, 32. In this case, the hinge 20 becomes a conventional two-leaf hinge. The top end of the pin 26 without the extension element, is substantially flush with the top front end 60 of the second hinge element 24.

The use of the reinforcement kit 30, 32 enables conversion of the two-leaf hinge into a three-Leaf hinge, with consequent increase of the maximum load that the hinge can withstand. In fact, with the reinforcement element 30 and the extension element 32, the pin 26 is subjected to shearing stress instead of bending stress, and its strength increases. For example, the two-leaf hinge without the reinforcement kit can have a maximum load-bearing capacity of 100 kg, whereas the hinge with the reinforcement kit can have a maximum load-bearing capacity in the region of 130 kg. The reinforcement kit 30, 32 consequently enables increase in the load of the hinge in a simple and inexpensive way. The reinforcement kit 30, 32 can be mounted at any moment, also with the door or window already in place. In fact, it is sufficient to slide out the pin 26 of the two-leaf hinge and proceed with the sequence of assembly described previously.

The invention claimed is:

1. A hinge for doors or windows, comprising a hinge-pin defining an axis of rotation, a first hinge element and a second hinge element articulated to one another about said axis via said pin, in which the first hinge element and the second hinge element have respective through articulation seats for coupling with said pin and in which said pin has at a first end a head resting against a bottom front end of the first hinge element and a second end substantially flush with a top front end of the second hinge element, the hinge comprising a reinforcement kit comprising an extension element configured as an element separate from the pin that can be applied by shape fit to said second end of the pin, said extension element projecting beyond the top front end of the second hinge element, and a third hinge element configured separate from the first and second hinge elements and connected to the first hinge element in a pre-set position, the third hinge element having a hole that can be engaged by said extension element of the pin.

2. The hinge according to claim 1, wherein the second end of said pin has a hole coaxial to said axis of rotation and in that said extension element comprises a first cylindrical portion, which establishes a shape fit with said hole.

3. The hinge according to claim 2, wherein said extension element comprises a second cylindrical portion separated from said first cylindrical portion by an annular collar, which rests frontally against said second end of said pin.

4. The hinge according to claim 3, wherein said collar has an external diameter substantially equal to the external diameter of said pin.

5. The hinge according to claim 1, wherein said third hinge element comprises a head, in which said hole that can be engaged by said extension element is formed, the head of the third hinge element being connected to a coupling portion via a spacing portion.

6. The hinge according to claim 5, wherein said coupling portion is inserted in a groove with undercut cross section of the first hinge element.

7. The hinge according to claim 6, wherein said spacing portion rests against a top front end of the first hinge element.

8. The hinge according to claim 5, wherein the head of the third hinge element has a hole for a fixing screw.

* * * * *